US006189971B1

(12) United States Patent
Witzig

(10) Patent No.: US 6,189,971 B1
(45) Date of Patent: Feb. 20, 2001

(54) TASK CHAIR WITH ADJUSTABLE SEAT DEPTH

(75) Inventor: Uli Witzig, Wolfhausen (CH)

(73) Assignee: Provenda Marketing AG, Rehetobel (CH)

( * ) Notice: Under 35 U.S.C. 154(b), the term of this patent shall be extended for 0 days.

(21) Appl. No.: 09/348,294

(22) Filed: Jul. 7, 1999

(30) Foreign Application Priority Data

Jul. 7, 1998 (EP) ..... 98 810 643
Oct. 20, 1998 (CH) ..... 2113/98

(51) Int. Cl.[7] ..... A47C 3/025
(52) U.S. Cl. ..... 297/284.11; 297/284.1
(58) Field of Search ..... 297/284.1, 284.11, 297/300.2, 300.3, 284.4

(56) References Cited

U.S. PATENT DOCUMENTS 3,007,738 * 11/1961 Gardel et al. .
4,765,679 * 8/1988 Lanuzzi et al. .
5,588,708 * 12/1996 Rykken et al. .
5,716,099 * 2/1998 McDiarmid .

FOREIGN PATENT DOCUMENTS

4040138A1 6/1992 (DE) .
4126520A1 2/1993 (DE) .
19617689C1 7/1997 (DE) .
0 585 661 A1 3/1994 (EP) .
0587523A1 3/1994 (EP) .
0673216B1 9/1995 (EP) .
67174 10/1984 (FI) .
162994 12/1989 (NO) .

* cited by examiner

*Primary Examiner*—Milton Nelson, Jr.
(74) *Attorney, Agent, or Firm*—Burns, Doane, Swecker & Mathis, L.L.P.

(57) ABSTRACT

A task chair has a buttocks portion, with a size sufficient only for the bottom of a person sitting on it, and a thigh support separate from it. The thigh support is displaceable to at least partway under the buttocks portion and can be pulled forward while under the buttocks portion. As a result, the length of the seat surface can be adjusted to the body size of a person using the stool. The guide for the displacement is curved. The front edge of the buttocks portion is formed by padding that tapers in wedge-like fashion. The front part of the cushion rests on the thigh support, and the rear part is retained by a bearing shell. The buttocks portion can be designed to be pivoted together with the backrest.

18 Claims, 9 Drawing Sheets

TASK CHAIR WITH ADJUSTABLE SEAT DEPTH

This application claims priority under 35 U.S.C. §§119 and/or 365 to 98810643.1 filed in Europe on Jul. 7, 1998 and 1998 2113/98 filed in Switzerland on Oct. 20, 1998; the entire contents of which are hereby incorporated by reference.

BACKGROUND OF THE INVENTION

1. Field of the Invention

The present invention relates to a task chair with a support and with a seat that supports the buttocks and at least the part of the thigh near the buttocks.

2. Background Information

A conventional task chair has a standardized seat depth of approximately 40 to 43 cm. There is space on the seat surface for the buttocks and, depending on the size of the person sitting on the chair, a variable length of the thigh. For shorter persons, the front edge of the chair is often too far forward, so that the blood vessels in the legs are compressed by the front edge, thus hindering the blood supply to the legs. The unpleasant and unhealthy consequences are cold feet and varicose veins.

To correct the seat depth, in some task chairs, the position of the backrest is adjustable; that is, the person sitting in the chair can choose how great the distance between the front edge of the chair and the backrest should be. However, if the seat surface is physiologically shaped, then a shorter person sits too far forward or a tall person sits too far to the rear on the seat surface.

From German Patent DE 196 17 689 C (Faure), a seat depth adjustment for motor vehicle seats is known. In it, the seat region at the front of the seat is movable in the longitudinal direction of the vehicle. The front seat region is secured to the seat by two parallel retaining arms, which can be swivelled about a horizontal shaft fixed to the seat. Its top side is located partly under the seat surface. The retaining arms are articulated in the rear end of the moveable seat region, and a further, adjustable-length arm is pivotably secured to the seat at a rear shaft and articulated to the front end of the seat region. A disadvantage of this seat depth adjustment is that the retaining arms and the adjustable-length arm require shafts secured to the seat, which are disposed below and at a distance from the seat surface. Such a construction is unacceptable for task chairs for use in the office, because these arms under the seat surface are not only unattractive but do not guarantee enough space for the legs below the seat surface.

SUMMARY OF THE INVENTION

It is therefore an object of the invention to create a task chair, for instance for work at a desk or computer screen, that is adjustable to the body size of the person using the chair. The adjustment should be accomplished with the simplest and most-aesthetic possible means, and the chair adjusted to the person should be physiologically adapted as optimally as possible. In particular, the seat depth should be adjustable.

According to the invention, this is attained by a seat surface which has a buttocks portion large enough for the buttocks alone and a thigh support, which is separate from the buttocks portion and can be displaced to at least partway under the bearer part and be pulled forward while under the buttocks portion.

A task chair accordingly has a support, and on the support at least the following chair elements are secured:

a) a rear buttocks portion of the seat surface, with a depth adapted to a human bottom and in which a physiologically shaped seat depression is embodied, and b) a front thigh support of the seat surface, the thigh support being separate from the buttocks portion and supported such that it can be displaced in a circularly curved rail forward and backward relative to the support and the buttocks portion;

and on the underside of the seat surface, the arc of the rail runs past the seat surface under the buttocks portion and is curved toward the task chair so that the thigh support can be displaced to at least partway under the buttocks portion in the rail and can be pulled forward while under the buttocks portion.

Separating the actual seat surface for the buttocks, which must bear the load of the upper body of a person sitting on it, from the thigh support, which if the seat is in the correct position supports only the legs, makes it possible for the thigh support to be variable in length, because the thigh support can be put into positions with different spacings between the front edge and the buttocks portion. As a result, the total length of the seat surface can be changed, without this change in length changing the shape of the seat depression in the buttocks portion or its position with respect to an optional backrest or lumbar support. A person sitting on the chair always sits on the right spot in the seat depression and can have his legs supported as desired. The unused length of the thigh support, being under the buttocks portion, is not a hindrance in any way. Thanks to the lengthening of the thigh support by displacement, rather than for instance adding successions of parts, a seamless, continuous thigh support can be used. Furthermore, the specially shaped front edge remains at the very front in every position.

The thigh support is guided with a circularly curved displacement path. A curved guide on the one hand enables a physiological design of the thigh support with an upward-oriented rounding and a sloping front edge. In addition, the rounding makes space free under the buttocks portion, because thanks to the rounding, the spacing between the surfaces of the thigh support and the depression for the buttocks becomes all the greater, the farther the rounding or the thigh support extends to below the buttocks portion. This space is either needed or readily usable for the construction of the buttocks portion.

Thus a shallow transition from the buttocks portion to the thigh support can be made. To make the transition as imperceptible as possible, the buttocks portion in the front region is advantageously formed so that it tapers in wedge-like fashion. If at least the buttocks portion is padded, then the wedge-like front region of the padded buttocks portion expediently forms a cushion, which rests under load on the thigh support. The transition between the buttocks portion and the thigh support is thus fluid and virtually imperceptible. This makes it possible to dispense with a supporting construction, connected to the substructure of the buttocks portion, for padding the front edge of the buttocks portion. Such a supporting construction would surely be perceptible in the case of padding that tapers to a point or is wedge-like at the front. At the transition between the buttocks and the thigh, which is also the point of transition between the buttocks portion and the thigh support, great pressure on the cushion is not expected, if the seat is in the correct position, and a transition designed in this way is thus not perceived, at least when the seat is in an upright position.

Advantageously, the thigh support can be locked in various displacement positions. The displacement position can be locked by the load of the person sitting on the chair. This can be achieved by providing teeth or zigzags along a guide, both on the displaceable part and on the part guiding it; these teeth or zigzags mesh with one another when a load is put on the thigh support and thus make displacement at least more difficult, yet in the unloaded state, under tension or pressure, they slide easily past one another in the displacement direction on the displaceable part.

Expediently, two bearer parts bear the buttocks portion on both sides, and a guide in which the thigh support is displaceably supported is made in each of these bearer parts.

A lumbar support is preferably provided on the task chair, and its spacing from the seat surface is adjustable. This makes it possible to react to the body size of the user. The lumbar support can be performed by a support cushion that is rotatable about a horizontal axis and has at least three seat surfaces. These seat surfaces each have a different spacing from the pivot axis of the supporting cushion in the plane of symmetry of the chair, so that depending on the rotary position the support of the small of the back or lumbar spine of a user is provided farther forward or farther forward to the rear with respect to the seat depression or seat surface.

Advantageously, a backrest is formed by upholstery material disposed on a frame and spread over the lumbar support; the lumbar support adapts the upholstery material in the lumbar region to the shape of a human back. Such a backrest is adaptable, by adjusting the lumbar support in height and/or rotating the support cushion, to the body size and shape of the back of the chair user. The lumbar curvature of the backrest is greater or lesser depending on the setting and is located at a higher or lower level. The height adjustment preferably amounts to a maximum of 10 centimeters and the differences in depth between the various cushion positions amount to approximately three centimeters.

If the task chair is intended to have a pivotable backrest, and if the backrest is to be pivotable together with the buttocks portion as well, then the task chair has a support, and at least the following three chair elements are secured to the support:

a) a rear buttocks portion of the seat surface, the buttocks portion being articulated on the support on a pivot axis, with a depth adapted to a human bottom and in which a physiologically shaped seat depression is embodied, and b) a front thigh support of the seat surface, the thigh support being separate from the buttocks portion and being supported so as to be displaceable forward and backward relative to the bearer parts and the buttocks portion, the position of the thigh support being independent of any swiveling of the buttocks portion, and the arc of the rail runs on the underside of the seat surface under the buttocks portion and is curved toward the seat surface, so that the thigh support in the rail can be displaced to at least partway under the buttocks portion and can be pulled forward under the buttocks portion, and c) a backrest (123), pivotably connected to the buttocks portion (121") and supported on the support (119), which backrest can be swiveled in the same direction of rotation as the buttocks portion (121").

Advantageously, the seat is divided into a seat depression for the buttocks and a leg support for the thigh of a person sitting on the chair; the seat depression is also pivotable about a pivot axis in the region between the seat depression for the buttocks and the leg support, and the location of the leg support is independent of any swiveling of the seat depression.

Since only the seat depression or the buttocks portion is supported pivotably, the pivot axis is near a central region of the chair. The support for mounting this pivot axis therefore requires no parts that project far into the region of the front edge of the seat. The support accordingly has to support only lesser lever forces and can therefore be designed with slender members. What is more essential, however, is that the leg support be capable of being designed independently of the seat depression and therefore also positionable independently.

A leg support which is variable in terms of its length supporting the thighs and which is optionally removable furthermore makes it possible for instance to sit practically only on the buttocks region and thus to provide relief for the blood vessels in the legs. In particular, it makes it possible to adapt a chair to the body size of its user. By removing the leg support and optionally replacing it with terminal padding, the seat surface is limited to the seat depression. A seat without leg support may be advantageous for short people or for the handicapped.

The guide preferably describes a circular arc. As a result, the location of the leg support relative to the support height virtually does not change when the length is changed. Furthermore, displacing the leg support under the seat depression is possible, and the transition between the seat depression and the leg support can be made quite shallow, without having to limit the structural height of the seat depression or the buttocks portion for supporting the main load under the spinal column or under the ischium.

The seat depression is advantageously articulated on the support with two lateral swivel arms of a seat depression bearing shell on a bearer protrusion, and between these swivel arms or between the pivot points, a seat depression cushion can be embodied to taper in wedgelike fashion toward the front.

Regardless of the inclination of the seat depression, this protrusion assures a virtually imperceptible transition between the seat depression and the leg support, while the pivot axes are disposed laterally beside the seat region and can therefore be disposed at the level of the seat surface without being a hindrance to the person sitting.

A pivot axis is advantageously disposed between the backrest and the support, under the seat surface, in particular approximately in the extension of the spinal column of a person sitting on the chair. This arrangement makes it possible for all the mechanical parts to be disposed below the seat where they are especially inconspicuous to the eye of an observer.

If the seat is articulated on a first pivot axis and the backrest is articulated on a second pivot axis on the support, then advantageously an intermediate lever is articulated on one end on a third pivot axis on the seat and on the other on a fourth pivot axis on the backrest, and the pivot axes are oriented parallel, so that the four axes, in the side view of the chair, form the corner points of a quadrilateral with variable angles.

As a result, the seat surface, which is in a fixed relationship with the side of the quadrilateral between the first and third axes, is pivoted in the same direction of the backrest, which is in a fixed relationship with the side of the quadrilateral between the second and fourth axes. Depending on the ratio of the lengths of these sides of the quadrilateral to one another, the pivoting angle varies. Since the intermediate lever is concealed under the seat surface to the eye of a person standing or sitting, the seat surface can be embodied as virtually "floating". A connection between the seat and the support is necessary only in the region of the first pivot axis. A sliding block guide can be omitted.

Advantageously, the spacing between the first and third pivot axes is greater than the spacing between the second and fourth pivot axes, preferably being approximately twice as great. The angles of the quadrilateral are within the following ranges: Between 15°and 35° at the corner of the first axis, between 110° and 150° at the corner of the fourth axis, and 100° to 130° each for the other axis. As a result, the pivoting angle of the seat is less than the pivoting angle of the backrest, being approximately half as great given the preferred spacing and angle ratios.

Expediently, a gas spring is provided as a spring means, which preferably is articulated at one end on a fifth pivot axis on the backrest and on the other on a sixth pivot axis on the support. However, it could also be disposed between the third pivot axis and the support, or between the third and second axes.

The disposition of the gas spring between the support and the backrest contributes to the transparency of the construction and mode of operation of the chair. In particular, in the preferred disposition, the accessibility of the gas spring for assembly and servicing of the chair is better than in the other possibilities for disposition.

Advantageously, the backrest has a bearer part which is articulated on the support and is extended around and behind the seat, and on this bearer part on the front side has a back shell for supporting the back of a person sitting on the chair.

Advantageously, the bearer part of the backrest has two arms under the seat, between which arms the intermediate lever and optionally the gas spring are articulated. This makes for high lateral stability of the backrest and makes a symmetrical transfer of force possible both between the gas spring and the intermediate lever and between the bearing structure and the support.

Advantageously, the leg support can be locked in a given seat depth adjustment by means of a locking device. As a result, an unintended shift of the leg support can be averted.

Expediently, the locking device has locking pins, which are disposed on the leg support and snap into recesses in the mounts or guide, that is, on the support, and can be unlocked by actuating a common actuating device. This makes for simple operation.

BRIEF DESCRIPTION OF THE DRAWINGS

Other objects and advantages of the present invention will become more apparent to those skilled in the art upon reading the detailed description of the preferred embodiments, wherein like elements have been designated by like numerals, and wherein.

DETAILED DESCRIPTION OF THE PREFERRED EMBODIMENTS

Figure 1:
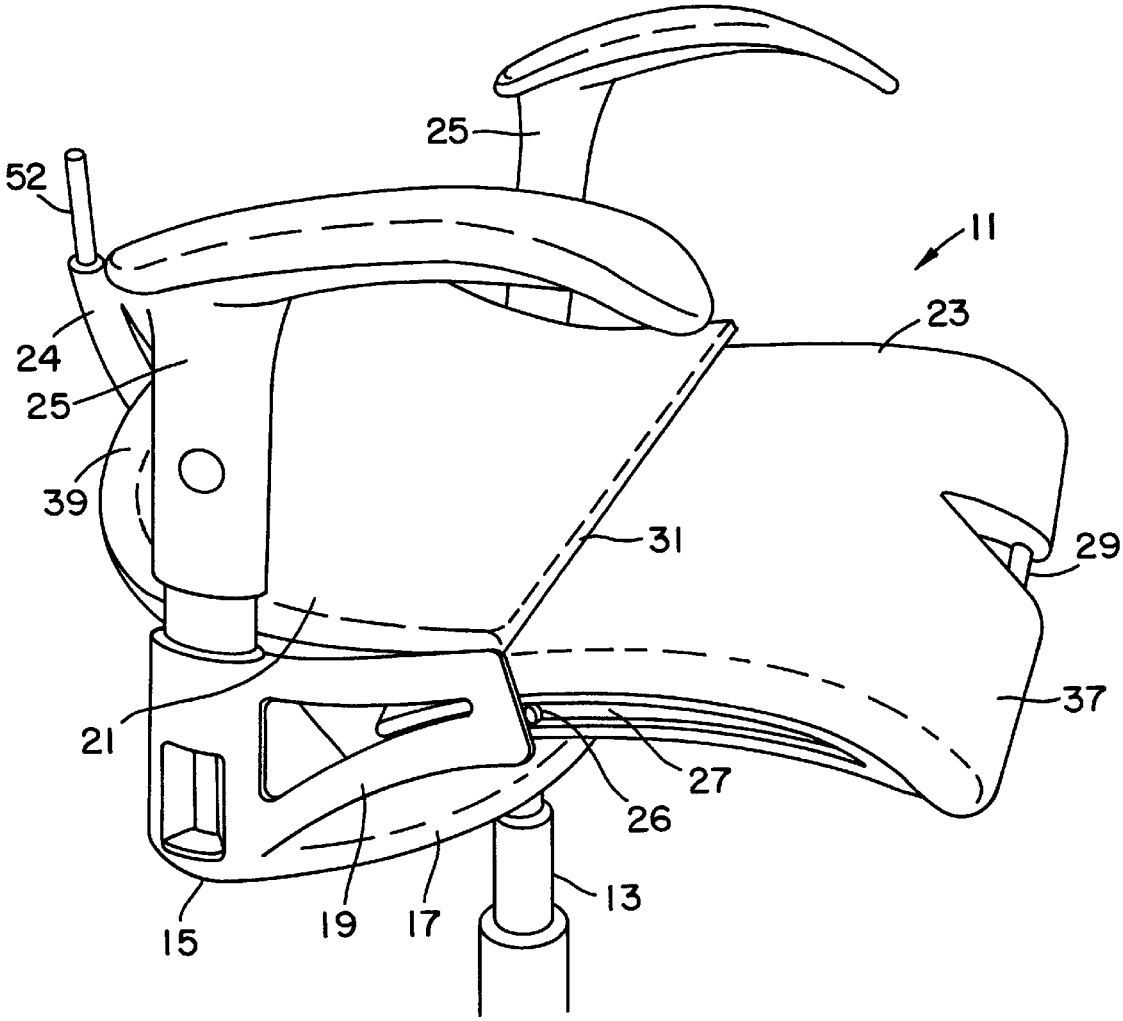
FIG. 1 is a perspective view of the seat part of a chair according to an exemplary embodiment of the invention.

FIG. 1 shows an exemplary seat part 11 according to a first exemplary embodiment of a task chair in accordance with the present invention. A bottom part 15 is rotatably disposed on a telescoping column 13. The bottom part 15 comprises a transverse bearer 17 and bearer parts 19, protruding upward from it, for the buttocks portion 21 and the displaceable thigh support 23. Also disposed on the transverse bearer 17 is a bearer 24 for a backrest, and the adjustable-height armrests 25 are seated in the bearer parts 19. Guide ribs 26 are formed on the bearer parts 19 and cooperate with guide grooves 27 on the thigh support 23. The guide grooves 27 are displaceable via the guide ribs 26. This allows the thigh support 23 to be slid beneath the buttocks portion 21. For pulling the thigh support forward, a handle 29 is formed on its front edge in the middle.

The front edge 31 of the buttocks portion 21 is as thin as possible or as appropriate, so that it will be as imperceptible as possible. The buttocks portion 21 and the thigh support 23 are padded. The front edge 31 of the buttocks portion 21, as the thinnest part of a wedge-like cushion, rests on the padding of the thigh support 23.

The thigh support 23 and the guide parts 26, 27 are curved in circular fashion. The center of their circle is located approximately 340 mm below the surface of the thigh support 23. In the front region 37, the thigh support 23 is curved more markedly, with a radius of approximately 110 mm, so that the front edge of the thigh support 23 slopes markedly downward. Exact dimensions referenced in connection with exemplary embodiments described herein can, of course, be varied in any desired manner.

The buttocks portion 21 is shaped in the manner of a depression. An upward-protruding edge 39 provides support from the rear, in particular, to the buttocks of a person sitting on the chair.

Figure 2:
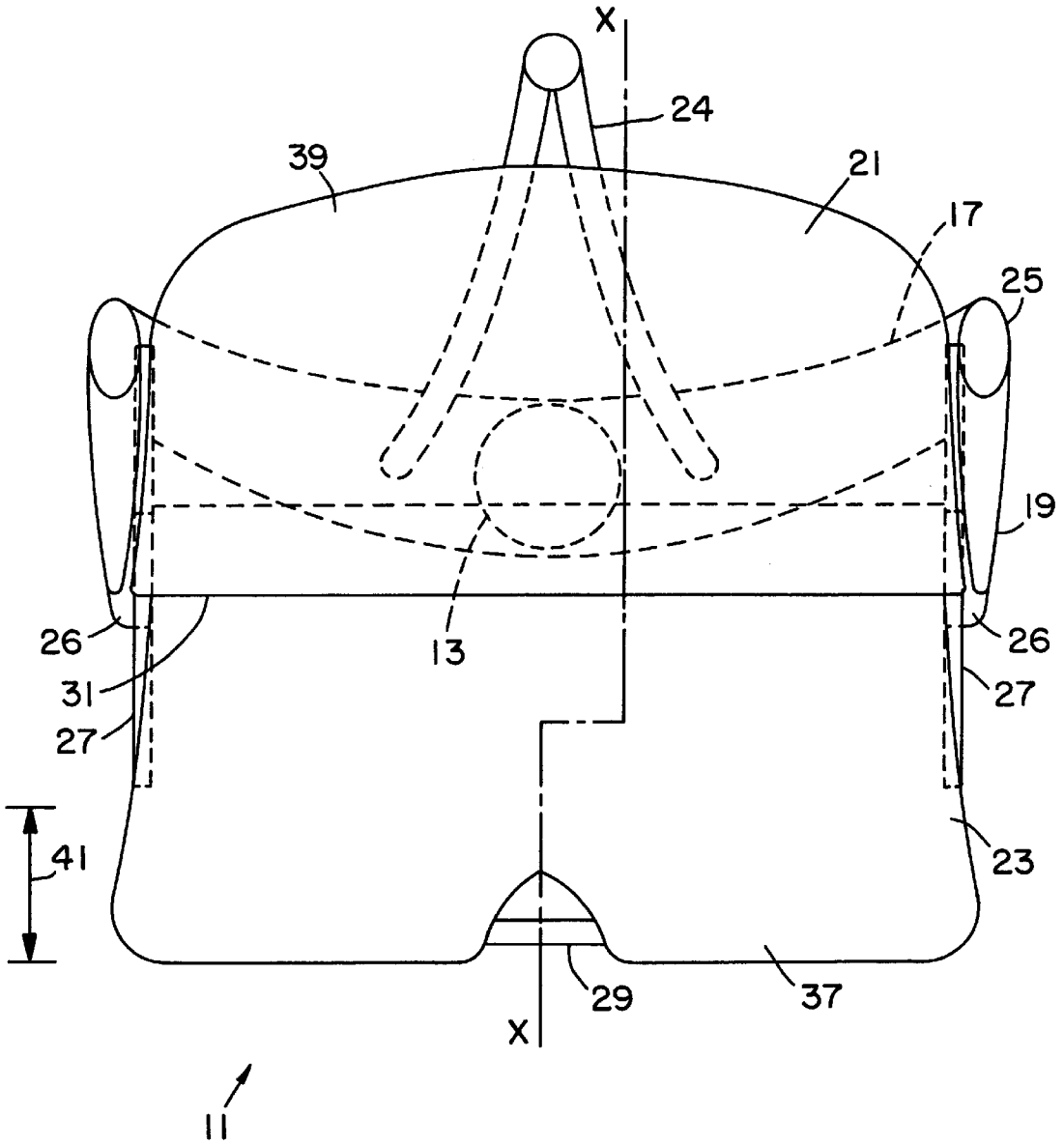
FIG. 2 is a plan view of the seat part of FIG. 1.

FIG. 2 shows the seat part 11 in a plan view. The thigh support 23 is shown in its forwardmost position. The parallel guides 26, 27 are disposed to the left and right of the thigh support 23. They make displacement of the thigh support 23 by a distance (arrow 41) of a good 10 cm possible, so that the seat depth can be selected between approximately 36 and 47 centimeters.

The column 13 is disposed below the center of gravity of a person sitting on the chair, and therefore under the buttocks portion 21. As can be seen in the section shown in FIG. 3 and taken along the line X—X of FIG. 2, the buttocks portion 21 and the thigh support 23 are each constructed of at least two layers. A bearing shell 43, 45 is covered with a layer 47, 49 of padding. A cover layer, such as upholstery fabric, is expediently spread over that. Under the ischium, that is, under the center of the depression of the buttocks portion 21, a bearer 51 is provided, which transmits the primary load to the side to the two bearer parts 19. This bearer is integrated with the bearing shell 43 of the buttocks portion 21.

Figure 3:
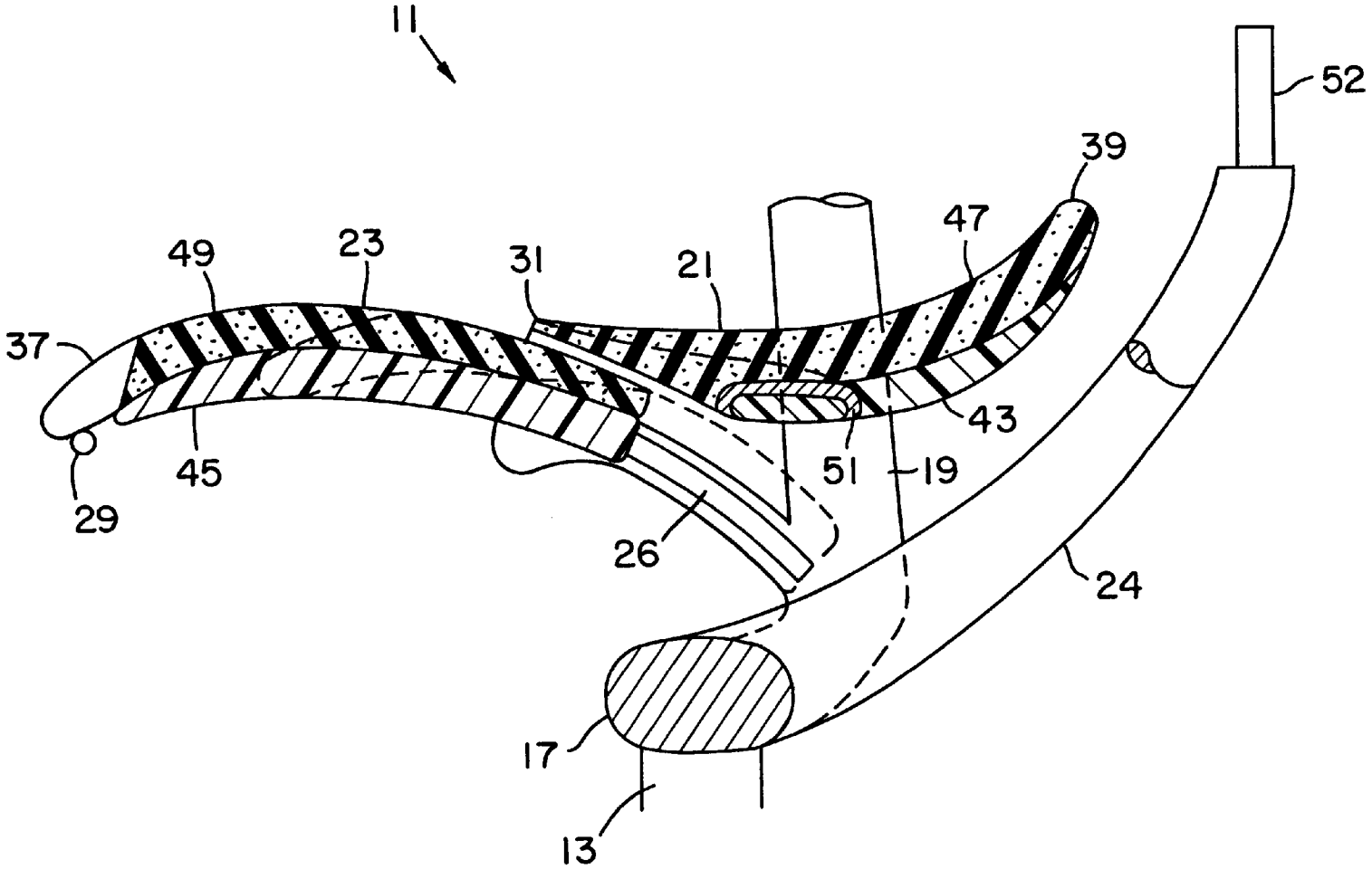
FIG. 3 is a section taken along the line X—X in FIG. 2.

From the sectional view in FIG. 3, it can be seen clearly that the front edge 31 of the buttocks portion 21 is not supported by the bearing shell 43 of the buttocks portion 21. The thigh support 23, however, is disposed directly under the padding, which tapers in wedgelike fashion toward the front, of the buttocks portion 21, so that a load exerted in front of the bearing shell 43 on the buttocks portion is supported on the cushion and the bearing shell 45 of the thigh support 21.

In the sectional view of FIG. 3, the thigh support 23 is also shown fully extended. Dashed lines show it in the fully retracted position as well.

Figure 4:
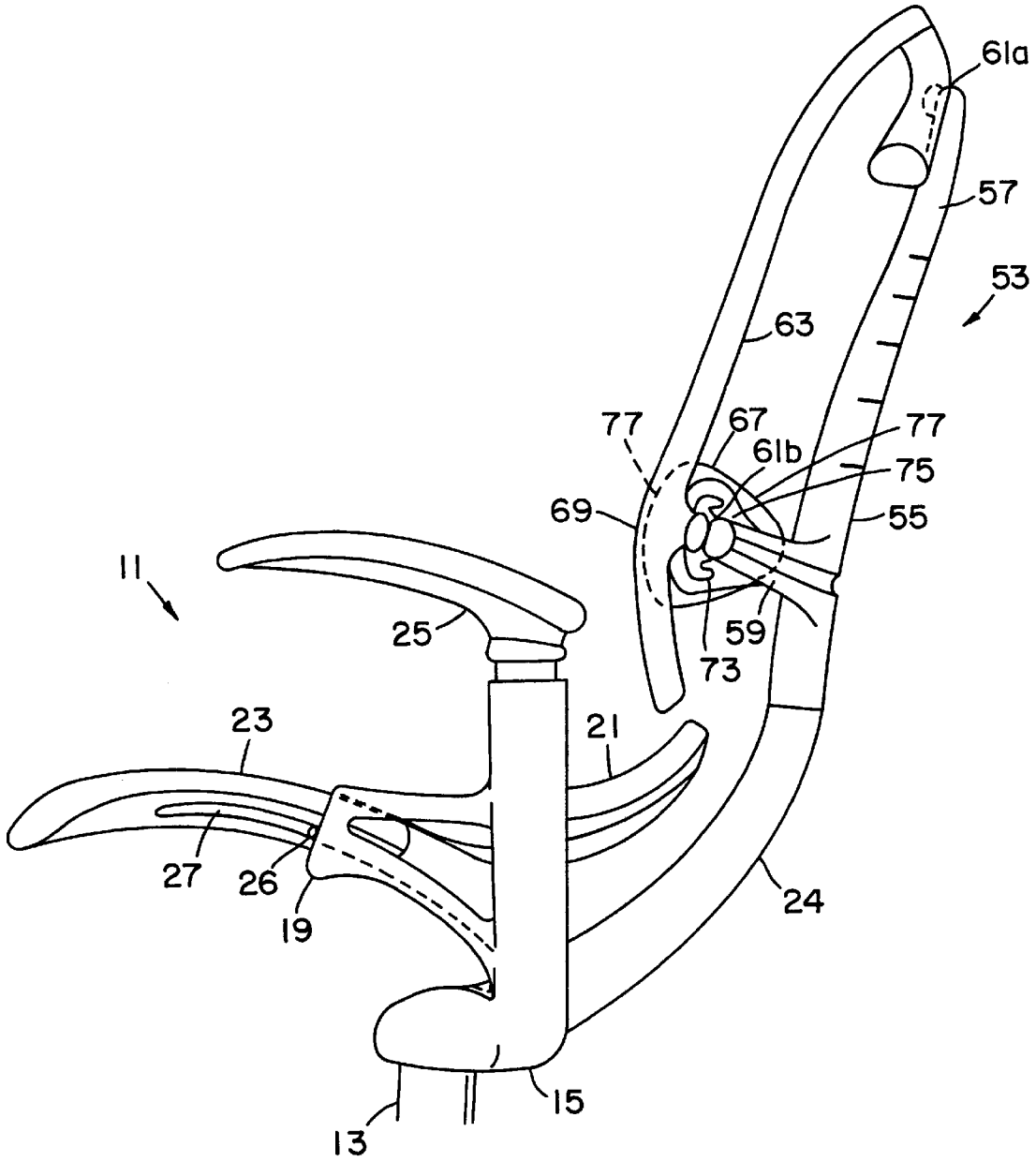
FIG. 4 is a side view of a task chair according to an exemplary embodiment of the invention.

FIG. 4 shows a task chair with a seat part 11 according to an exemplary embodiment of the invention and with a backrest 53. This backrest is seated on an arbor 52 (FIGS. 1 and 3) on the bearer 24. The backrest has a supporting skeleton with an ascending branch 57 and on both sides thereof an approximately horizontal branch 59. A frame part 63 is secured to the supporting skeleton 55 at the three fastening points 61 a through c. Upholstery, in the form of fabric or some other preferably air-permeable elastic material, is spread out over the frame part 63. This upholstery (FIG. 5, 65) is pressed forward by a lumbar support 67 in the lumbar region 69. The lumbar support 67 is formed by a triangular cushioning body, which is rotatable about its axis. Handles 71 are formed on the ends of the shaft. The axis is seated on both ends in one of a plurality of depressions 73 in a retaining jaw 75. The depressions are closed at the rear, so that the upholstery material 65 presses the shaft into the depression 73. Thanks to the elasticity of the upholstery material, however, the shaft can be raised out of the depression, counter to the pressure of the upholstery material 65, so that it can then be allowed to slide back into a depression 73 at a different distance from the seat surface 21, 23. By rotating the lumbar support 67, a different one of the three seat surfaces 77 is rotated counter to the upholstery material. Each of the three seat surfaces is shaped differently, so that the backrest 53 in the lumbar region 69 is shaped differently, depending on the rotational position of the lumbar support. One seat surface 77 is curved forward in the horizontal direction, a second is curved to the rear, and the third is approximately level.

Figure 5:
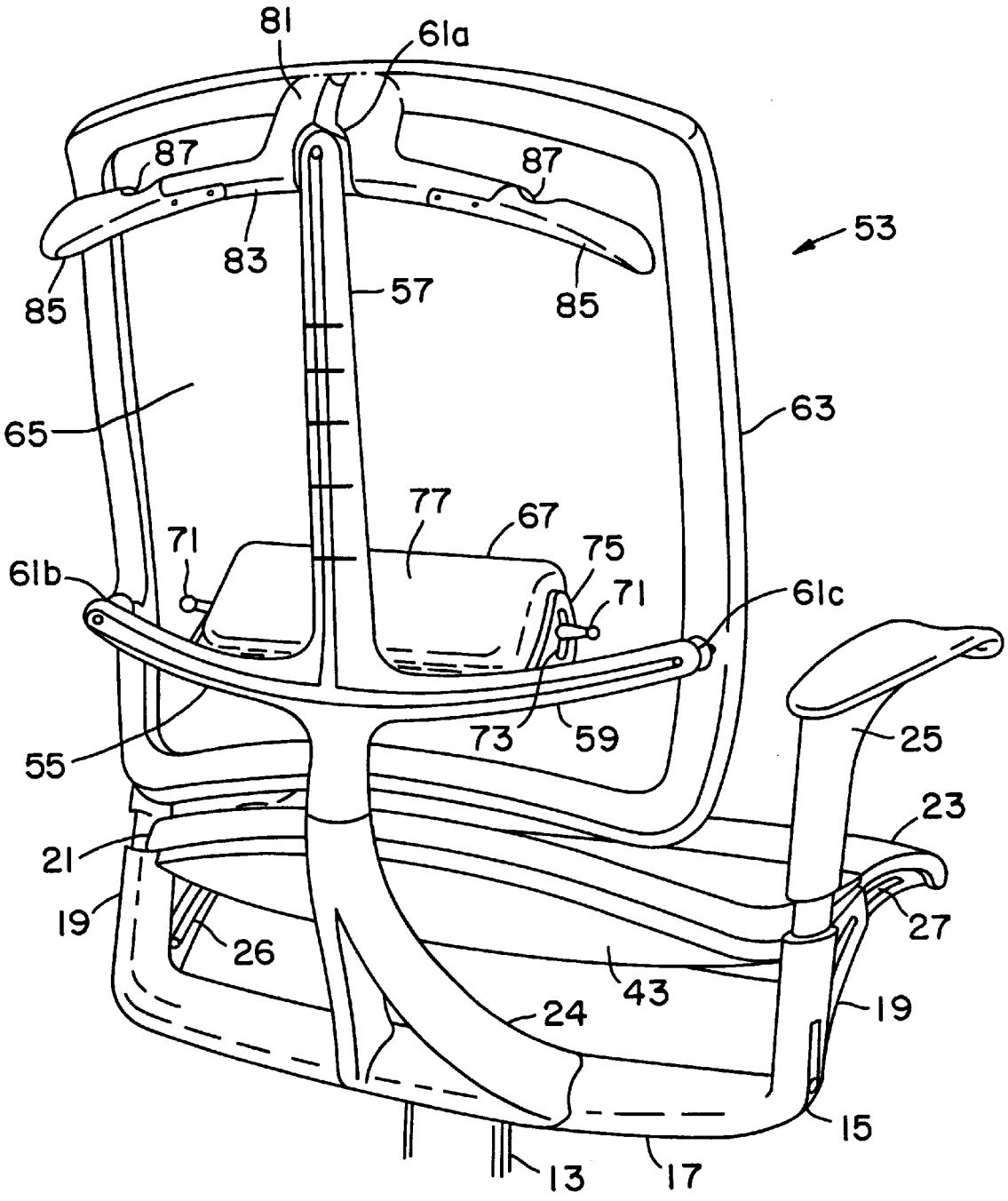
FIG. 5 is a perspective rear view of the task chair of FIG. 4.

This backrest 53 is shown in prospective in FIG. 5. Since the frame part 63, like the ascending branch 57 of the supporting skeleton 55, is elastic, elastic intermediate parts 79 are disposed between the supporting skeleton 55 and the frame part 63, at the fastening points 61*a* through 61*c*.

Approximately parallel to the upper edge of the frame part 63 and spaced apart from it, a clothes hanger 83 is mounted on the frame part 63 via a strut 81. The clothes hanger has elastic end portions and notches 87. Thanks to the notches 87, a handbag can also be hung from the close hanger 83. Because of the elastic ends 85, bumping against the ends of the clothes hanger 83 is not painful. An article of clothing hung from the clothes hanger creates a climatic buffer zone behind the upholstery material 65.

So that the displaceable thigh support 23 will not be undesirably displaced, it is lockable. This is accomplished for instance with a clamping screw (not shown). Locking of the thigh support is also attainable by providing toothing on the guide rib 26 and guide groove 27. When a load is put on the thigh support 23, the teeth embodied on the upper groove face 89 mesh with the teeth embodied on the upper rib face. The teeth on the guide rib 26 need to be provided only in the front region of the rib. The teeth on the guide groove 27, however, must be provided over the entire length of the groove. If the teeth are embodied as a frustoconical zigzag line, then the thigh support 23 or the guide 26, 27 can be displaced, given enough clearance between the underside 97 of the rib 26 and the lower groove face 99. To prevent the displacement, the two zigzag lines can be pressed against one another with spring means. If the guide groove is formed on the bearer part 19 and the guide rib is formed on the thigh support 23, then the teeth should be correspondingly disposed on the lower faces of the rib and groove.

Figure 6:
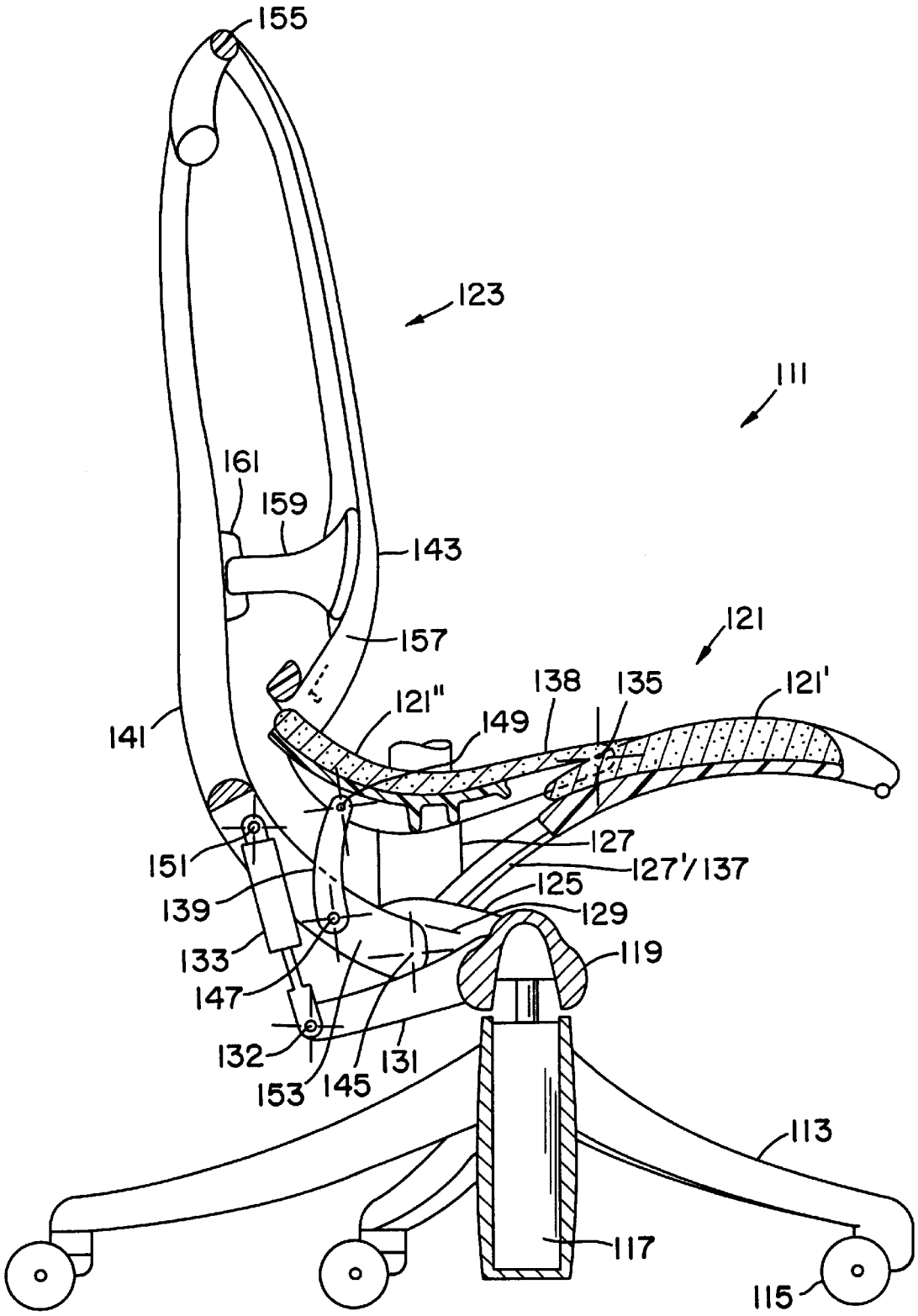
FIG. 6 is a schematic vertical section approximately along the plane of symmetry through a chair according to an exemplary embodiment of the invention with a pivotable buttocks portion.
Figure 7:
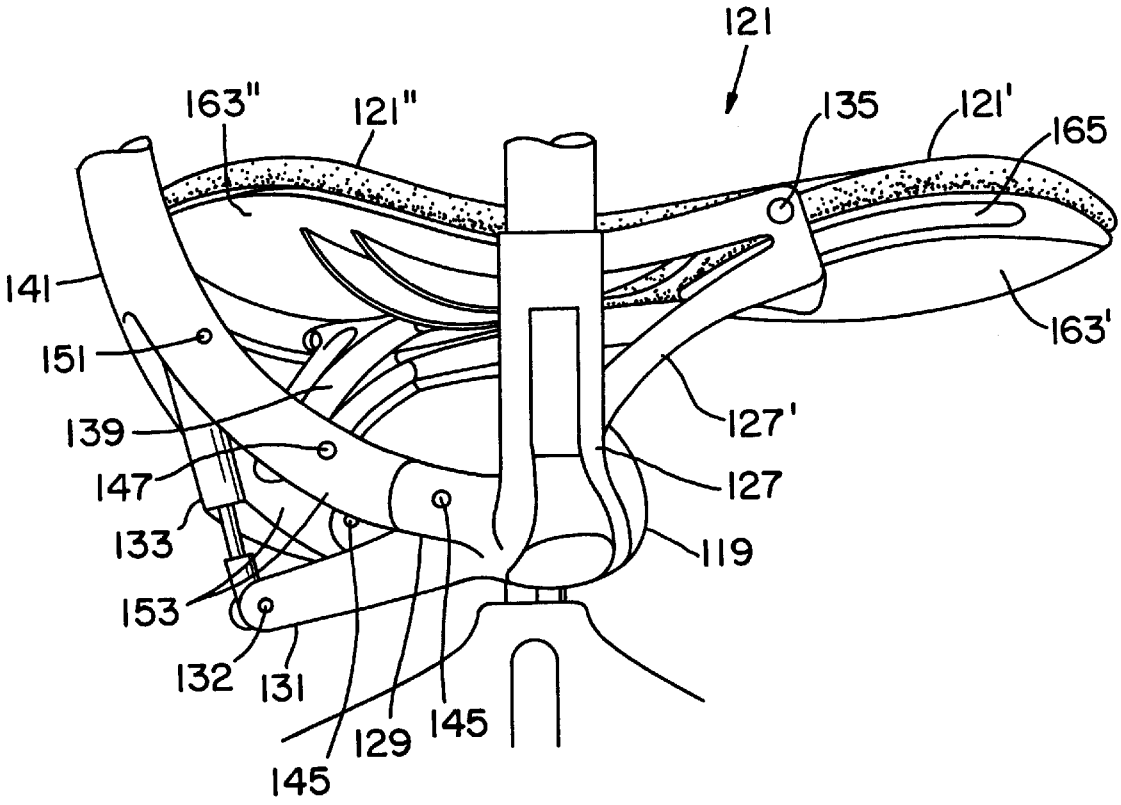
FIG. 7 is a perspective view from below under the seat surface of the chair of FIG. 6.
Figure 8:
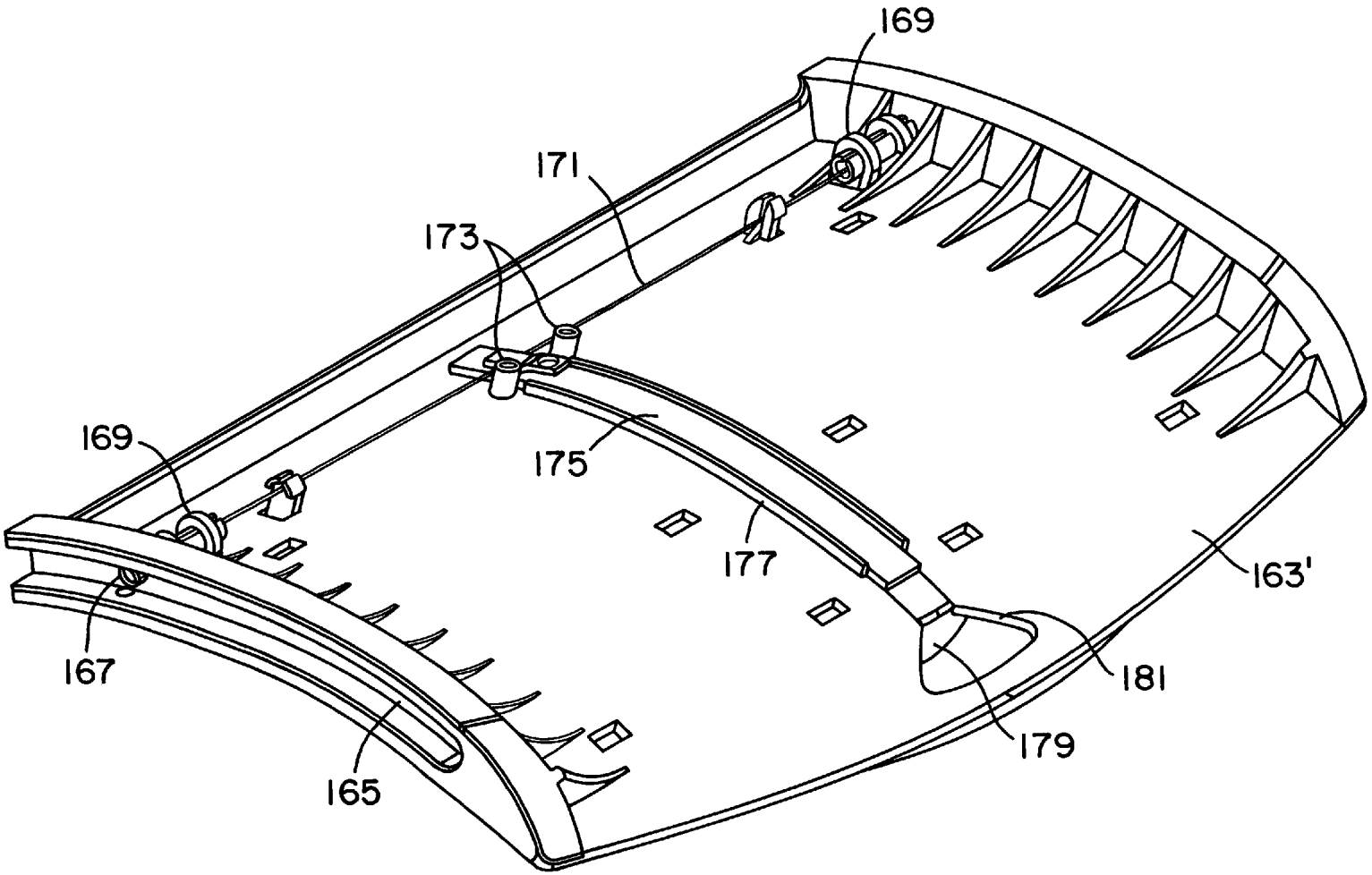
FIG. 8 is a perspective view of the bearer part of the displaceable thigh support.

FIGS. 6 through 8 show a second exemplary embodiment of the present invention. The chair 111 in FIG. 6 has a five-armed base 113 with casters 115. An adjustable-height gas spring 117 is disposed in the base, and a support 119 is disposed on this spring. The support 119 carries the seat 121, backrest 123, and armrests (which are not shown, for the sake of simplicity). Under the seat 121, the support 119 forms a transverse rod 125 of curved form, on the sides of which two outward-jutting mounts or bearer parts 127 for the seat 121 and the armrests are formed. On these mounts or bearer parts 127, forward- facing protrusions 127' are formed, on which the seat 121 is secured. On the transverse rod 125 and pointing rearward, two joint sets 129 for the backrest 123 and one arm 131 are disposed, with a pivot point 132 for the gas spring 133.

The seat 121 is divided into two parts: a leg or thigh support 121' in the front and a rear seat depression 121" for the buttocks of a person sitting on the chair 111. The seat depression or buttocks portion 121" is articulated at the pivot point 135 to the forward-oriented protrusions 127' of the mount 127. For articulation of the seat depression 121", each mount 127 has a bearing or an axis at the pivot point 137. A guide 137 for the leg support 121' is also formed on each protrusion 127'. In or on these guides 137, the leg support 121' can be displaced to beneath the seat depression 121" or can be pulled forward under the seat depression 121".

Between the pivot points 137, the seat depression cushion 138 is embodied in wedgelike form, tapering toward the front. The pivot points 135 are located approximately at the same level as the seat surface and beside it. They are preferably disposed in the region of the point of the wedge of the buttocks portion cushion.

In the rear region, the seat depression 121" is articulated with an intermediate lever 139 on the backrest 123, and in particular on the supporting structure 141 for a back shell 143 of the backrest 123. The supporting structure 141 is articulated at the pivot point 145 to the joint set 129 on the support 119. Spaced apart from this first pivot point 145, the intermediate lever 139 is articulated to the supporting structure 141 at a second pivot point 147. At a third pivot point 149, the intermediate lever 139 is articulated to the seat depression 121", or the bearing shell 163", of the buttocks portion 121".

If the backrest is swiveled rearward, than the second point 149 moves away from the point 135 where the buttocks portion is articulated to the support, and the first and third points 145 and 149 move closer together. The seat depression 121" is pivoted rearward (counterclockwise) about its pivot point 135 in this process. The leg support 121', however, remains in its position. The rearward motion of the backrest 123 is spring-cushioned and can be accomplished only if the spring force of the gas spring 133 is overcome. If this counterforce lets up, the gas spring 133 returns the seat back 123 forward.

The supporting structure 141 is bifurcated in the region of the pivot points 145, 147, 151. The intermediate lever 139 and the gas spring 133 engage the inside of the supporting structure 141 between the two branches 153. The arm 131 is also bifurcated at the pivot point 132.

A tension frame 155 is disposed on the supporting structure 141, at a plurality of elastic bearing points. An air-permeable woven cloth fabric 157 is spread out over the tension frame 155, to form a back shell 143. To form a lumbar curvature, a prop 159 is disposed behind the fabric 157 and braces the fabric 157 in the lumbar region relative to the supporting structure 141. This prop 159 is adjustable in height. To that end, a plurality of cutouts in which corresponding protrusions on the prop 159 snap into place, are provided in a holder part 161 on the supporting structure 141. Depending on the level at which the prop 159 is disposed, the protrusions snap into different cutouts.

In FIG. 7, the seat adjusting mechanics are shown in a perspective view from below the seat 121. The bifurcation of the supporting structure 141 in the region of the pivot points 145, 147, 151 is clearly apparent. The branches 153 are each articulated individually on a joint set 129. The intermediate lever 139 is disposed on a shaft extending through both branches 153 and also on a shaft on the underside of the bearing shell 163" of the seat depression 121". Between the joint sets 129, the arm 131, where the compression spring 133 is attached, extends rearward. This compression spring 133 is seated with its other end between the two branches 153 of the supporting structure 141 of the backrest.

In FIG. 7, the mounts 127 with the protrusions 127' are shown. The protrusions 127' have an upper portion, to which the seat depression is articulated at 135. They also have a lower part, extended in a circular arc, on whose inside the guide 137 is formed. Rails 165 that cooperate with the guides 137 are embodied in the bearing shell 163' of the thigh support 121', so that the thigh support 121' can be displaced in the guides 137 to beneath the seat depression 121".

FIG. 8 shows a bearing shell 163' of the thigh support 121' of FIGS. 6 and 7 with the locking device. The bearing shell 163' is a plastic part, which is covered with padding. It has two guide grooves or rails 165 on the sides, in which in the assembled state of the chair the guides 137 on the projection 127' are engaged with a rib. In the respective rib, a number of recesses are formed (not shown), of which a given recess cooperates with a pin 167 to lock the thigh support 121'. The pins 167 face one another in the rear region of the thigh support 121', each being guided translationally in a sleeve 169 on the bearing shell 163', and are pressed outward into the position of engagement by spring means disposed in the sleeve 169. A cable 171 is fastened between the pins 167. The cable moves in a straight line past two deflectors 173 and is fastened between them on a slide 175. If the slide 175 is displaced forward, then the middle of the cable is moved out of the straight line between the deflectors 173, and the cable 171 is thus made taut. Because of the resultant shortening of the distance between the two ends of the cable, the pins 167 are thus pulled out of the recesses in the ribs, making the thigh support 121' displaceable in the guides 137. The slide 175 is guided vertically to the direction of the cable between the cushion and the bearing shell 163', in a guide 177 on the bearing shell 163 that follows the contour of the bearing shell 163 and is thus in the form of a circular arc. A handle 179 extends downward through an opening 181 in the bearing shell 163' to below the seat 121 and can be grasped in the vicinity of the front edge of the thigh support 121'.

Instead of a thigh support 121' that is displaceable and lockable, padding on the end can also be disposed adjacent to the front edge of the seat depression 121" . This limits the seat surface to the depth of the seat depression 121'. Such a chair without a thigh support 121' is suitable for human beings with particular forms of physical handicap or malformation.

Figure 9:
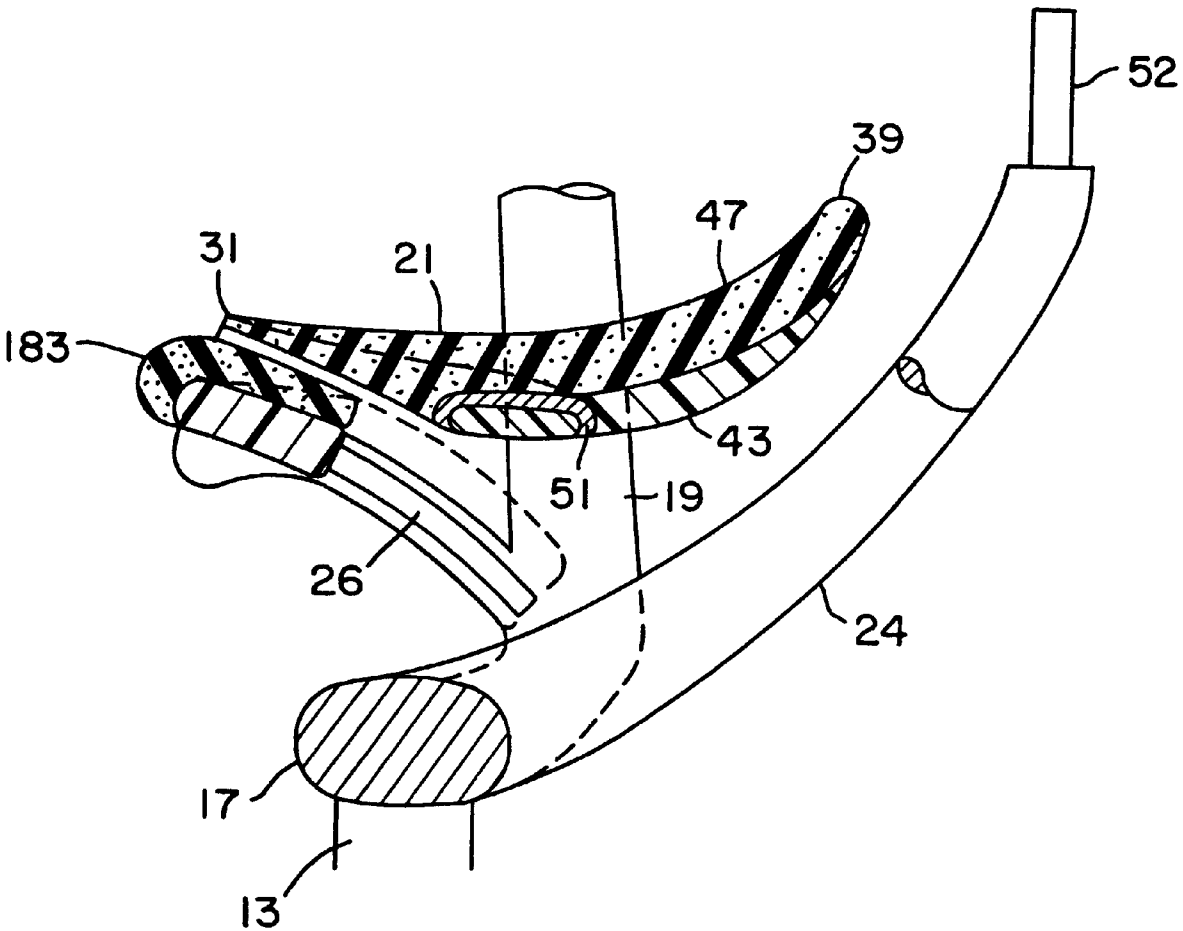
FIG. 9 is a schematic vertical section through a chair with a special terminal element instead of the displaceable thigh support.

This special terminal part 183 is shown in FIG. 9 in conjunction with a chair in accordance with the first, simpler exemplary embodiment of FIGS. 1 through 5; the same part can also be used in the chair 111 with the pivotable buttocks portion. It has a load-bearing core and padding on the top with rounding at the front. The rounding directly adjoins the tip 31 of the wedge of the buttocks portion 21. The protrusions mentioned in one of the two exemplary embodiments are quite generally usable in the other exemplary embodiment as well.

In summary, it can be said that in a task chair 111 with a support 119 for a seat 121 and a backrest 123 that swivels backward resiliently under load, the seat 121 is divided into a rear seat depression 121" and a front thigh support 121'. The seat depression 121" is articulated with an intermediate lever 139 on the backrest 123, or its supporting structure 141, and on its front end is articulated at the pivot points 135 to parts 127, and in particular 127', that are solidly joined to the support 119. If the backrest 123 is swivelled, then the seat depression 121" is also swivelled, but not the thigh support 121'. The thigh support 121' can thus be displaced on or in a guide 137 disposed on the support 119 so that it slides beneath the seat depression 121".

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A task chair comprising:

a support; and secured to the support:

a) a rear buttocks portion of a seat surface having a depth adapted to a human bottom in which a physiologically shaped seat depression is embodied, wherein the buttocks portion is shaped to taper in wedge-shaped fashion in its front region; and b) a front thigh support of the seat surface, the thigh support being separate from the buttocks portion and being supported for displacement forward and backward relative to the support and the buttocks portion in a circularly curved rail, wherein the arc of the rail runs under the buttocks portion and is curved toward the seat surface so that the thigh support is supported for displacement to at least partway under the buttocks portion in the rail and can be pulled forward while under the buttocks portion.

2. The task chair of claim 1, wherein seat depth is adjustable between approximately 36 and 47 centimeters.

3. The task chair of claim 1, wherein at least the buttocks portion is padded, and the wedge-shaped front region of the buttocks portion forms a cushion, which under load rests on the thigh support.

4. The task chair of claim 1, wherein the thigh support can be locked in any one of a plurality of displacement positions.

5. The task chair of claim 1, wherein the thigh support is removable and can be replaced by a terminal padding of the front edge of the buttocks portion.

6. The task chair of claim 1, wherein two bearer parts bear the buttocks portion, and a guide in which the thigh support is displaceably supported is made in each of these bearer parts.

7. A task chair comprising:

a support; and secured to the support:

a) a rear buttocks portion of a seat surface, the buttocks portion being articulated on the support on a pivot axis, with a depth adapted to a human bottom in which a physiologically shaped seat depression is embodied;

b) a front thigh support of the seat surface, the thigh support being separate from the buttocks portion and being supported for displacement forward and backward relative to bearer parts of the buttocks portion, the position of the thigh support being independent of any swiveling of the buttocks portion, and the thigh support being supported for displacement along a circular arc to at least partway under the buttocks portion and can be pulled forward while under the buttocks portion; and c) a backrest, pivotably connected to the buttocks portion and supported on the support, which backrest can be swivelled in a direction of rotation of the buttocks portion.

8. The task chair of claim 7, in which the pivot axis, about which the buttocks portion can be swivelled, is disposed in a region between the buttocks portion and the thigh support.

9. The task chair of claim 7, wherein the buttocks portion is articulated on the support with a bearing shell, and between pivot points located on the bearing shell, a seat depression cushion is embodied, the front of the buttocks portion protruding past the bearing shell and tapered in wedge-shape fashion.

10. The task chair of claim 7, wherein the backrest is articulated on the support on a second pivot axis, and an intermediate lever is articulated on one end on a third pivot axis on the seat and on another end on a fourth pivot axis on the backrest, the pivot axes being oriented parallel so that the four axes, in a side view of the chair, form corner points of a quadrilateral with variable angles.

11. The task chair of claim 10, wherein spacing between the first pivot axis and the third pivot axis is greater than spacing between the second pivot axis and the fourth pivot axis, and an angle of the quadrilateral is within a range of 15° to 35° at a corner point of the first pivot axis and within a range of 110° to 150° at the corner point of the fourth pivot axis, and the angles in two remaining corner points of the quadrilateral have similar values to one another.

12. The task chair of claim 10, comprising:

a gas spring which is articulated at one end on a fifth pivot axis on the backrest and on another end on a sixth pivot axis on the support.

13. The task chair of claim 7, wherein the backrest has a bearer part which is articulated on the support and is extended around and behind the seat, and has a back shell on this bearer part on the front side for supporting a back of a person sitting on the chair.

14. The task chair of claim 13, wherein the bearer part has two arms under the seat, between which arms an intermediate lever and a gas spring are articulated.

15. The task chair of claim 7, wherein the thigh support can be locked in a given seat depth adjustment by means of a locking device.

16. The task chair of claim 15, wherein the locking device has locking pins which are disposed on the thigh support and snap into recesses of the bearer parts and can be unlocked by actuating a common actuating device.

17. A task chair comprising:

a support; and secured to the support:

a) a rear buttocks portion of a seat surface having a depth adapted to a human bottom in which a physiologically shaped seat depression is embodied; and b) a front thigh support of the seat surface, the thigh support being separate from the buttocks portion and being supported for displacement forward and backward relative to the support and the buttocks portion in a circularly curved rail, wherein the thigh support is removable and can be replaced by a terminal padding of the front edge of the buttocks portion, and wherein the arc of the rail runs under the buttocks portion and is curved toward the seat surface so that the thigh support is supported for displacement to at least partway under the buttocks portion in the rail and can be pulled forward while under the buttocks portion.

18. A task chair comprising;

a support;

a rear buttocks portion of a seat surface, the rear buttocks portion being articulated on the support on a pivot axis, with a depth adapted to a human bottom in which a physiologically shaped seat depression is embodied; and a front thigh support of the seat surface, the thigh support being separate from the buttocks portion and being supported for displacement forward and backward relative to bearer parts of the buttocks portion in a circularly curved rail, wherein the thigh support can be locked in any one of a plurality of displacement positions.

* * * * *